US005449070A

United States Patent [19]

Broderick

[11] Patent Number: 5,449,070

[45] Date of Patent: Sep. 12, 1995

[54] CARRIER STRUCTURE

[75] Inventor: Norman Broderick, Stockport, United Kingdom

[73] Assignee: Morton International Limited, Hounslow, England

[21] Appl. No.: 178,550

[22] Filed: Jan. 7, 1994

[30] Foreign Application Priority Data

Jan. 12, 1993 [GB] United Kingdom ..... 9300450

[51] Int. Cl.[6] ..... B65D 85/67

[52] U.S. Cl. ..... 206/396; 206/416

[58] Field of Search ..... 206/389, 395, 396, 397, 206/53, 54, 408, 413, 415, 416, 521, 586, 594; 242/588.6, 588.4, 596.7

[56] References Cited

U.S. PATENT DOCUMENTS 1,889,933 12/1932 Pratt ..... 206/396
2,860,773 11/1958 Zackheim .
3,272,326 9/1966 Kutlow ..... 242/588.6 X
3,989,203 11/1976 Williams .
4,160,533 7/1979 Kotzur et al. ..... 206/397 X
4,435,479 3/1984 Pivoteau et al. .
4,511,037 4/1985 Lucous ..... 206/396
4,817,796 4/1989 Camillo et al. ..... 206/396
4,826,100 5/1989 Belliveau ..... 242/588.6 X
4,877,133 10/1989 Klentes et al. ..... 206/415 X
5,053,811 10/1991 Watabe et al. ..... 206/397 X

FOREIGN PATENT DOCUMENTS 0081427 12/1981 European Pat. Off. .
2577900 2/1985 France .

*Primary Examiner*—Jacob K. Ackun
*Attorney, Agent, or Firm*—Nick C. Kottis; Gerald K. White

[57] ABSTRACT

A carrier structure which may serve as an end fitting for roll assemblies in connection with packaging film materials is disclosed.

9 Claims, 4 Drawing Sheets

CARRIER STRUCTURE

This invention relates to a carrier structure particularly but not exclusively for use as an end fitting in a roll assembly.

It is well known to package film material by winding it on a cardboard tube which is then provided with plastics end fittings and inserted in a rectangular box for transportation. A typical end fitting comprises a square plate with an integrally moulded hollow cylindrical spigot formation which fits into the respective end of the tube and provides a carrier handle on the outer face of the fitting. When the film material is to be used the roll is removed from its packaging and the end fittings are discarded. With increasing environmental awareness, the disposal of synthetic plastics packaging material causes problems for the customer.

It is an object of the present invention to provide a carrier structure, which may be used as such an end fitting, which is made of disposable material but nevertheless has substantial structural strength. According to a first aspect of the present invention there is provided a carrier structure comprising a folded blank of stiff paper material having a central panel defining a front wall of the structure, and side panels with outer edge flaps folded over the central panel to provide a rear wall of the structure with said edge flaps projecting through slots in the central panel to provide a load-bearing projection on the front wall.

Preferably, the central panel is of square or rectangular shape, a first opposed pair of said side panels has its edge flaps superposed and extending through a first slot in the central panel, and a second opposed pair of said side panels has its edge flaps superposed and extending through openings in said first side panels and through a second slot in the central panel intersecting said first slot at right angles.

The second panel edge flaps may have outer half-slots cooperating with inner half-slots of the first panel edge flaps so as to permit intersection of said edge flap pairs.

In order to improve the structural strength of the carrier structure, the side panels preferably have inner edge portions providing side walls spacing apart the front and rear walls to create a hollow box shape.

A carrier handle may be provided by an opening in the rear wall, preferably by an aperture in an overlying side panel coincident with apertures in two underlying side panels.

The stiff paper material is preferably corrugated board and advantageously double-walled corrugated board which is preferably diagonally fluted so that when the load-bearing projection on the front wall of the carrier structure comprises two intersecting pairs of edge flaps, the flutes of the two flaps of each pair extend in opposite directions so as to improve the structural strength of the projection.

According to a second aspect of the present invention there is provided a roll assembly comprising an open-ended roll, for example of film material, supported at each end by a carrier structure as claimed in any one of the preceding claims, the load-bearing projection of each structure engaging in the respective end of the roll.

The invention will now be further described by way of example only, with reference to the accompanying drawings, in which.

Figure 1:
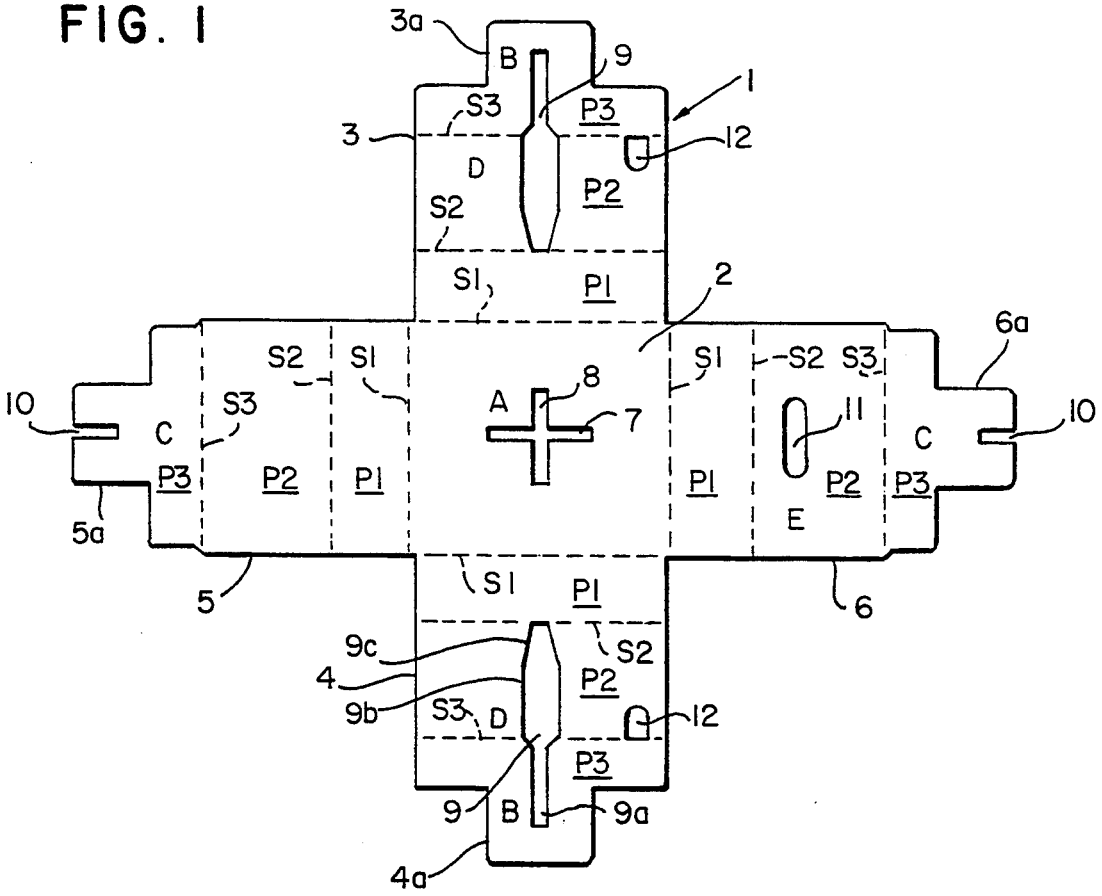
FIG. 1 shows a pre-cut blank ready for folding into one embodiment of a carrier structure in accordance with the invention.

Referring now to FIG. 1, a flat die-cut blank 1 is made of diagonally fluted double-walled corrugated board material and has a square central panel 2 interconnecting four rectangular side panels which are opposed in two pairs 3, 4 and 5, 6. The outer edge of each side panel 3–6 is provided with a rectangular flap 3*a*–6*a* and each side panel is provided during cutting of the blank with score lines S1 separating the respective side panel from the central panel 2, S2 defining with the inner score line S1 an inner edge portion P1 of the respective side panel, S3 defining with the score line S2 a central part P2 of the respective side panel and with the edge flap a panel portion P3.

The central panel 2 has crossed first and second slots 7, 8 and the first pair of opposed side panels 3, 4 each have a slot 9 having a parallel-sided narrow portion 9*a* extending over the width of the panel portion P3 and half of the width of the edge flap 4*a* and connected at its inner end to a wide section 9*b* extending across the panel portion P2 and terminating in a tapered portion 9*c*. The edge flaps 5*a*, 6*a* of the other pair of side panels 5, 6 have edge slots 10 extending from the outer edge to the centre of the respective flap. A handle opening 11 is provided in the panel portion P2 of the side panel 6 and corresponding finger openings 12 are provided adjacent the score line S3 and one lateral edge of the panel portion P2 of each of the side panels 3, 4.

Figure 2:
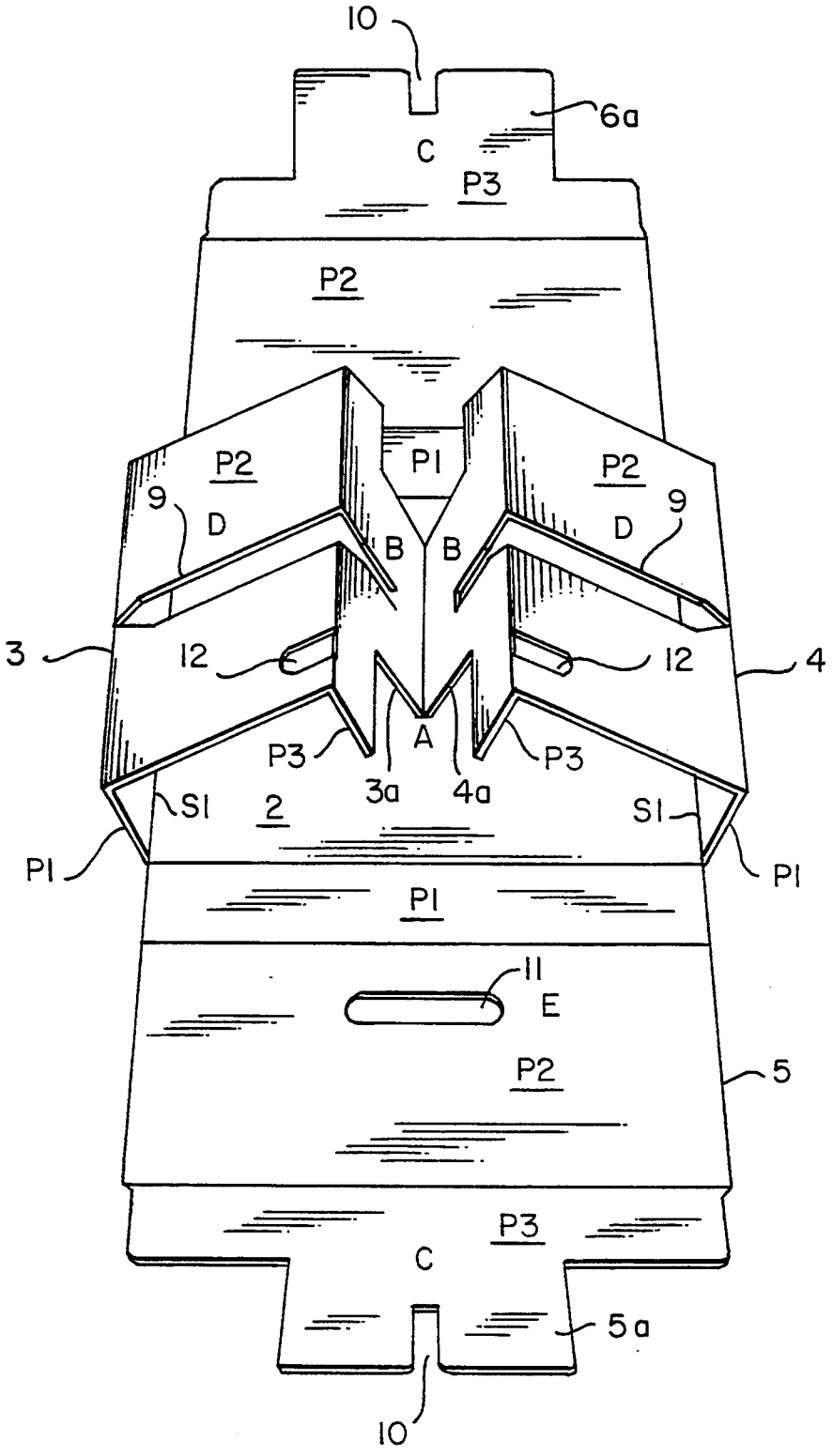
FIG. 2 shows the blank of FIG. 1 in the partially folded condition.
Figure 3:
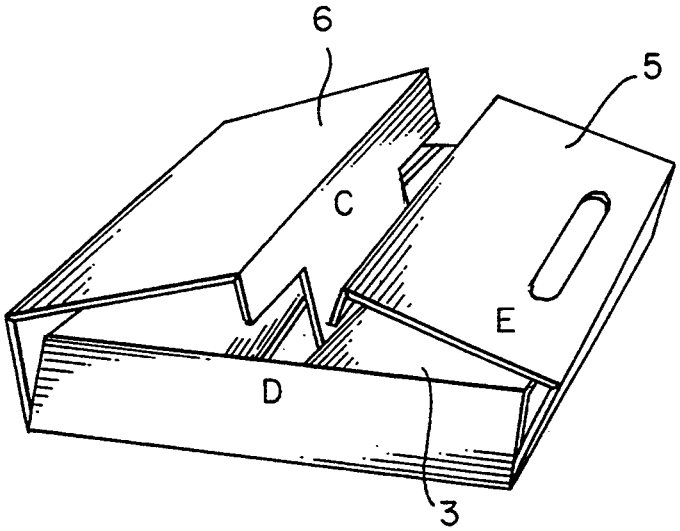
FIG. 3 shows the final stage of the folding operation.
Figure 4:
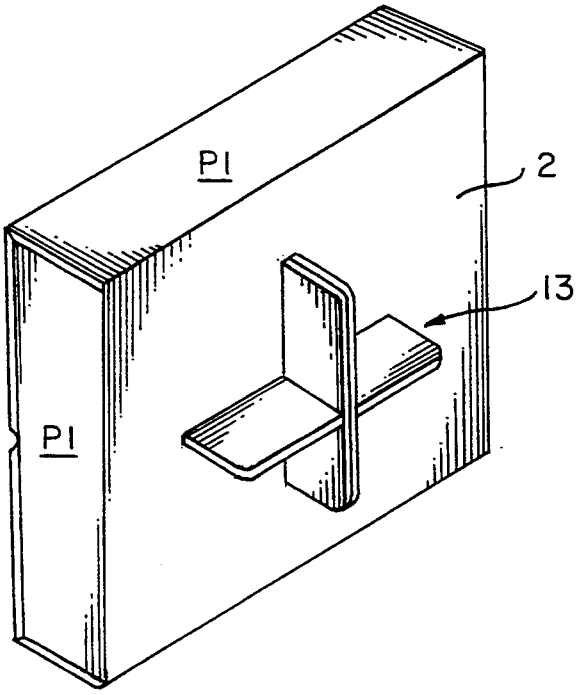
FIG. 4 is a front view of the completed carrier structure.

In order to assemble the blank 1 into the carrier structure as shown in FIG. 4 the blank 1 is folded along the score lines as shown in FIGS. 2 and 3. The first pair of opposed side panels 3, 4 are folded over the central panel 2 along score lines S1 so that the edge flaps 3*a*, 4*a* can be inserted into and through the slot 7 in the central panel 2. The flaps 3*a*, 4*a* and the adjacent panel portions P3 are thus forced into close overlapping relationship, the central portions P2 of the side panels 3, 4 ultimately being brought into a plane parallel to and spaced from the central panel 2, the requisite spacing being insured by the panel portions P1 and P3. The side panels 5, 6 are then folded onto the side panels 3, 4 and the edge flaps 5*a*, 6*a* are inserted into the slots 9 in the side panels 3, 4 and through the slot 8 in the central panel 2. This folding action results in the edge flaps 5*a*, 6*a* and the adjacent panels P3 being brought into close overlapping relationship and the slots 10 of the edge flaps 5*a*, 6*a* engaging the outer parts of the edge flaps 3*a*, 4*a*.

Folding of the side panels 3, 4 brings the finger openings 12 of the panel portions P2 into close proximity and folding of the side panel 6 positions the opening 11 over the openings 12 so as to provide a handle in the finished structure.

Figure 5:
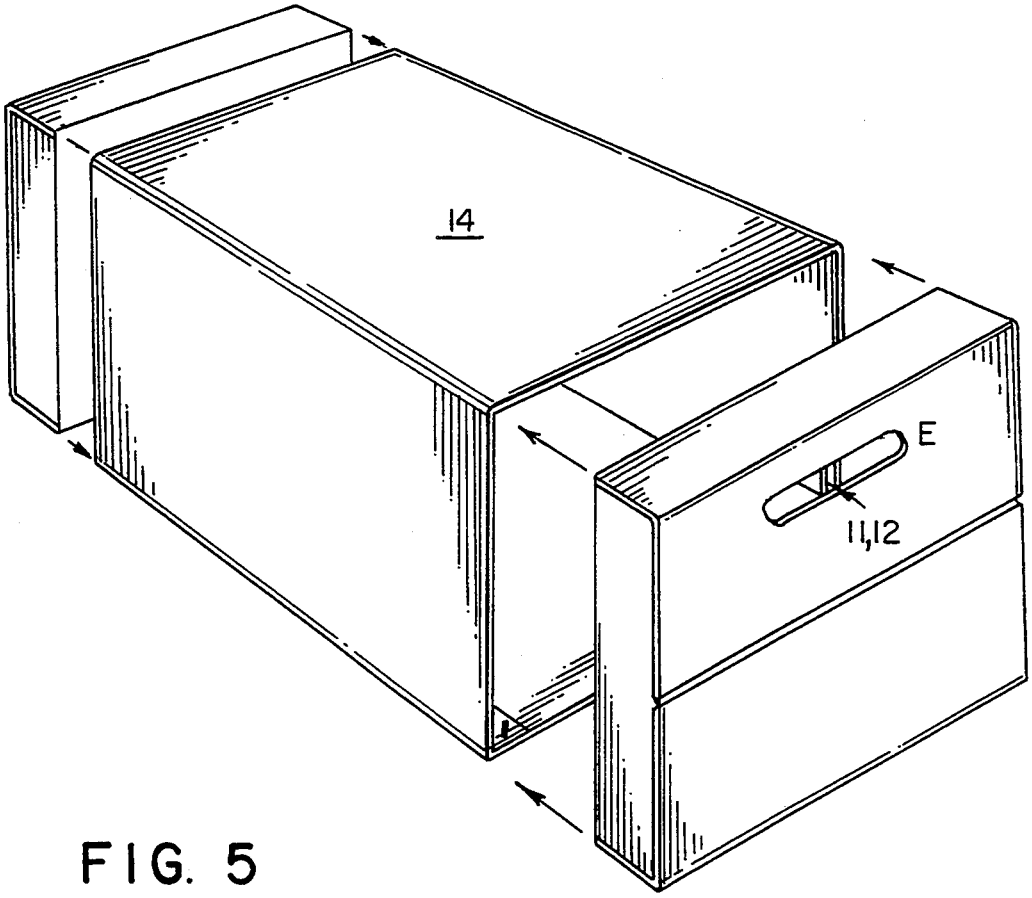
FIG. 5 shows two carrier structures in accordance with FIG. 4 in use as packaging for a roll assembly.

In the assembled structure shown in FIG. 4 a front wall is provided by the central panel 2 and a rear wall by the side panel pairs 3, 4 and 5, 6. The front and rear walls are held in spaced apart relationship by side walls constituted by the panel portions P1 of the side panels 3–6. The edge flaps *3a–6a* project through the front wall 2 to provide a cross-shaped load-bearing projection indicated generally at 13. As shown in FIG. 5, two carrier structures as shown in FIG. 4 may provide end walls of a packaging carton including a sleeve 14 which is cut to suit the length of the product to be packaged and is secured, as by stapling, to the end fittings. The product may conveniently be a roll of film material wound onto a cardboard former having an internal diameter corresponding to the width of the projection 13 such that the projections 13 are a tight fit in opposite ends of the former with the handles 11, 12 uppermost. The weight of the roll of film material is taken by the projections 13 and the sleeve 14 serves simply to envelop the product and interconnect the carrier structures.

Figure 6:
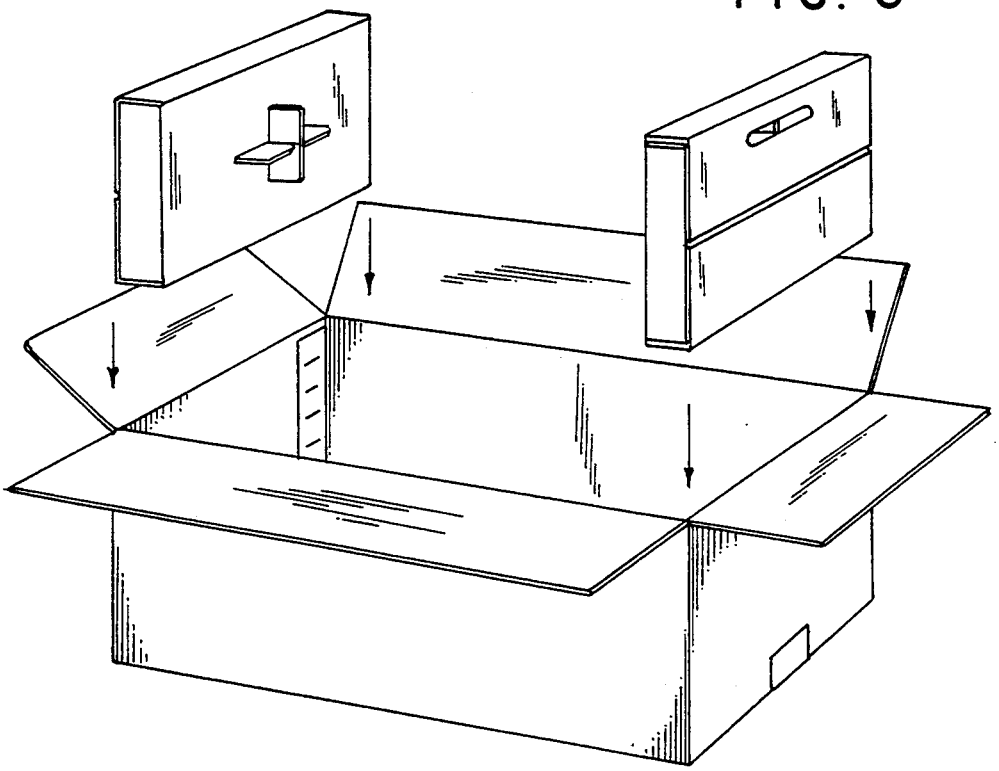
FIG. 6 shows an alternative packaging use.

In an alternative packaging assembly shown in FIG. 6, the carrier structures supporting the roll (not shown) in the manner described are inserted into opposite ends of a rectangular box shaped carton with the usual top closure flaps.

Figure 7:
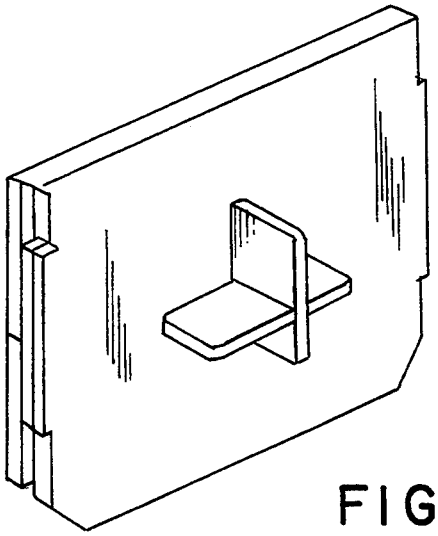
FIG. 7 is a front view of a second embodiment of carrier structure in accordance with the invention.

FIG. 7 shows an alternative embodiment of carrier structure in which the side wall panel portions P1 are omitted or reduced in width such that the side panels overlying the central panel are in contact therewith. The carrier structure of FIG. 7 may be used as a roll end fitting but in this case the roll and end fittings must be packaged in a carton as shown in FIG. 6 since the side panel portions P1 are insufficiently wide to take the sleeve 14. In other respects the blank from which the carrier structure of FIG. 7 is formed is similar to that shown in FIG. 1 save that no finger openings 12 are provided and the slots 9 are of uniform width over their full length.

It will be appreciated that the carrier structure of the invention may be modified without departing from the scope of the appended claims. For example, each of the two pairs of opposing side panels may provide only a single edge flap such that the load-bearing projection is formed by two intersecting edge flaps instead of two pairs of such flaps as described and illustrated. An additional handle may be provided at the opposite side of the carrier structure. Although the primary use of the carrier structures described is as end fittings for rolls of material, alternative uses are contemplated in which a rigid supporting structure is required.

I claim:

1. A roll assembly comprising an open-ended roll supported at each end by a carrier structure comprising a folded blank of stiff paper material having a central panel defining a front wall of the structure, and side panels with outer edge flaps folded over the central panel to provide a rear wall of the structure with said edge flaps projecting through slots in the central panel to form a load-bearing projection on the front wall, the load-bearing projection of each structure engaging in the respective end of the roll.

2. An assembly as claimed in claim 1, wherein the central panel is of square or rectangular shape, a first opposed pair of said side panels has its edge flaps superposed and extending through a first slot in the central panel, and a second opposed pair of said side panels has its edge flaps superposed and extending through openings in said first side panels and through a second slot in the central panel intersecting said first slot at right angles.

3. An assembly as claimed in claim 2, wherein the second panel edge flaps have outer half-slots cooperating with inner half-slots of the first panel edge flaps so as to permit intersection of said edge flap pairs.

4. An assembly as claimed in claim 1, wherein the side panels have inner edge portions providing side walls spacing apart the front and rear walls to create a hollow box shape.

5. An assembly as claimed in claim 1, wherein an opening in the rear wall provides a carrying handle.

6. An assembly as claimed in claim 5, wherein said opening is provided by an aperture in an overlying side panel and coincident apertures in two underlying side panels.

7. An assembly as claimed in claim 1, wherein the stiff paper material is corrugated board.

8. An assembly as claimed in claim 7, wherein the corrugated board is double-walled.

9. An assembly as claimed in claim 7, wherein the corrugated board is diagonally fluted.

* * * * *